United States Patent [19]

Mueller

[11] Patent Number: 4,848,738

[45] Date of Patent: Jul. 18, 1989

[54] WEIGHT STACK WITH VACUUM-ACTUATED PNEUMATIC MOTOR FOR LIFT ASSIST

[76] Inventor: King L. Mueller, P.O. Box 1401, North Platte, Nebr. 69103

[21] Appl. No.: 118,018

[22] Filed: Nov. 6, 1987

[51] Int. Cl.[4] ..... A63B 21/06

[52] U.S. Cl. ..... 272/118; 60/412

[58] Field of Search ..... 60/407, 409, 411–412, 60/433; 91/443; 272/118, 123

[56] References Cited

U.S. PATENT DOCUMENTS

| | | | |
|---|---|---|---|
| 4,253,662 | 3/1981 | Podolak | 272/123 |
| 4,509,745 | 4/1985 | Angsten | 272/118 X |
| 4,609,189 | 9/1986 | Brasher | 272/129 X |

FOREIGN PATENT DOCUMENTS

| | | | |
|---|---|---|---|
| 1085602 | 4/1984 | U.S.S.R. | 272/118 |

OTHER PUBLICATIONS

"Fitness Shop Section", *Muscle & Fitness*, Nov. 1986, p. 235.

*Primary Examiner*—Robert E. Garrett
*Assistant Examiner*—George Kapsalas

[57] ABSTRACT

Airlift apparatus used in conjunction with a weight lifting machine that utilizes a stack of weighs. It assists the weight lifter when fatigue occurs. Its construction is of plastic, consisting of a cylinder and a piston. The piston is moved by differences in air pressure which is induced by a vacuum pump located at the bottom of the cylinder. A cable and a series of pulleys connect the weight stack to the piston. The system is activated by the lifter at any stage of the lift by a foot or hand operated switch. When not in use the Airlift does not adversely affect the normal operations of the weight lifting machine.

1 Claim, 4 Drawing Sheets

WEIGHT STACK WITH VACUUM-ACTUATED PNEUMATIC MOTOR FOR LIFT ASSIST

BACKGROUND OF THE INVENTION

Modern research has determined that greater strength gains can be made if a muscle can continue to contract after reaching muscle failure. In current weight lifting programs this is done by a lifting partner who will physically assist the lifter when fatigue occurs. The assist usually consists of two or three repetitions after muscle failure.

SUMMARY OF THE INVENTION

The Airlift Apparatus utilizes a cylinder with an air pressure powered piston. The air pressure power is provided by a vacuum pump driven by an electric motor. The piston is connected to a weight stack by a series of pulleys and a cable.

The size of the cylinder can be made to variable lengths thus insuring proper stroke necessary for specific weight lifting machines.

The amount of assist or the power output of the piston can be controlled by a variable speed electronic switch connected to the pump motor. Other variables such as pump capacity and cylinder volume can also be varied to induce different power ranges.

The Airlift can be activated by the user through the use of a foot or hand switch depending on the exercise being performed. When the system is activated, the piston provides a smooth power surge that will aid the user through the lift.

When deactivated the weight stack returns to its original position, thus returning the piston to its original position. When the Airlift system is not being used it will not interfere with the normal operations of the weight lifting machine.

BRIEF DESCRIPTION OF THE DRAWINGS

Some of the objects of the invention having been stated, other objects will appear as the description proceeds, when taken in connection with the accompanying drawings, in which.

DETAILED DESCRIPTION OF PREFERED EMBODIMENT

While the present invention will be described hereinafter with particular reference to the accompanying drawings, in which an operating embodiment of the apparatus of the present invention is shown, it is to be understood at the outset of the description which follows that it is contemplated that apparatus and methods in accordance with the present invention may be varied from the specific form described hereinafter while still attaining the desired result of this invention. Accordingly, the description which follows is to be understood as a broad teaching disclosure directed to persons of appropriate skill in the appropriate art, and not as limiting upon the scope of this invention.

Figure 1:
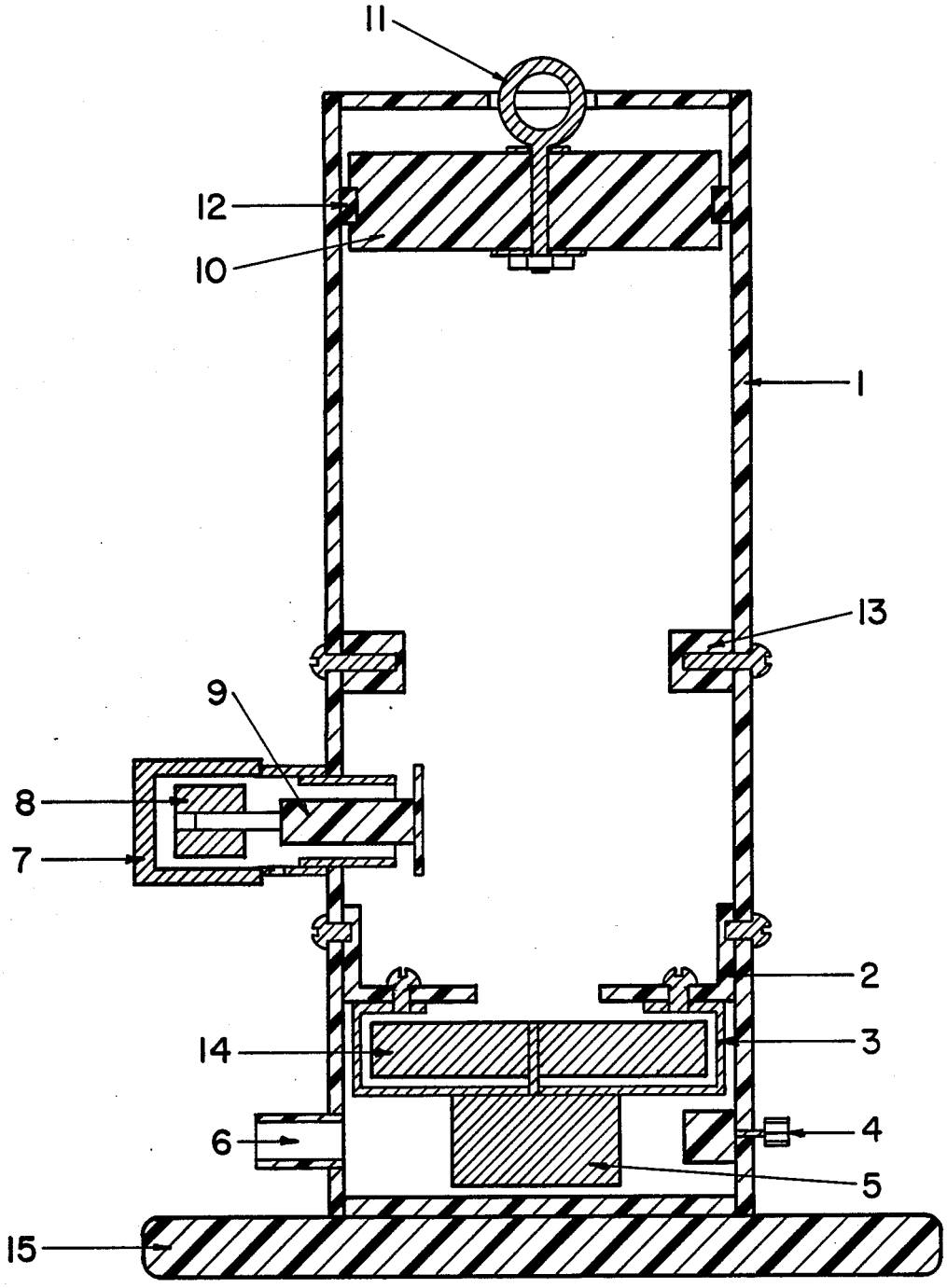
FIG. 1 is a cross section of the Airlift unit drawn to expose the major components of the apparatus.

Referring more particularly to FIG. 1; the main cylinder 1 consists of PVC pipe diameter 10", although this could be altered to fit the particular weight machine. The cylinder 1 is then secured to a plastic base plate 15 by PVC glue. Length of the cylinder 1 again could be altered to needs. The demonstration model is 39" in length. Fitted inside the cylinder 1 is the plastic piston 10. The piston is sealed by a rubber O-ring 12. Mounted in the center of the piston 10 is an eyebolt 11 for cable attachments.

Mounted inside and on the bottom of the cylinder 1 is the pump mounting bracket 2. Screws fasten the pump housing 3 to the internal mounting bracket 2. The pump's electric motor 5 and the pump rotors 14 are shown in their respective positions. Located at the bottom of the cylinder 1 along with the pump motor 5 is the variable speed electronic switch 4 for regulation of pump speed. Located opposite of the control switch is the pump exhaust outlet 6.

Mounted above the pump unit mounting bracket 2 is the air pressure purge valve which consists of an electrical solenoid 7, a solenoid piston 8, and the plunger valve 9. The purge valve is used to seal the cylinder when the unit is activated and to allow internal vacuum to return to normal after deactivation, thus allowing the piston 10 to return to the original position. Located slightly above the purge valve is the piston stop mechanism 13 which consists of plastic material and is fastened by glue and screws. The purpose of the piston stop mechanism 13 is to prevent the piston 10 from striking the purge valve.

Figure 4:
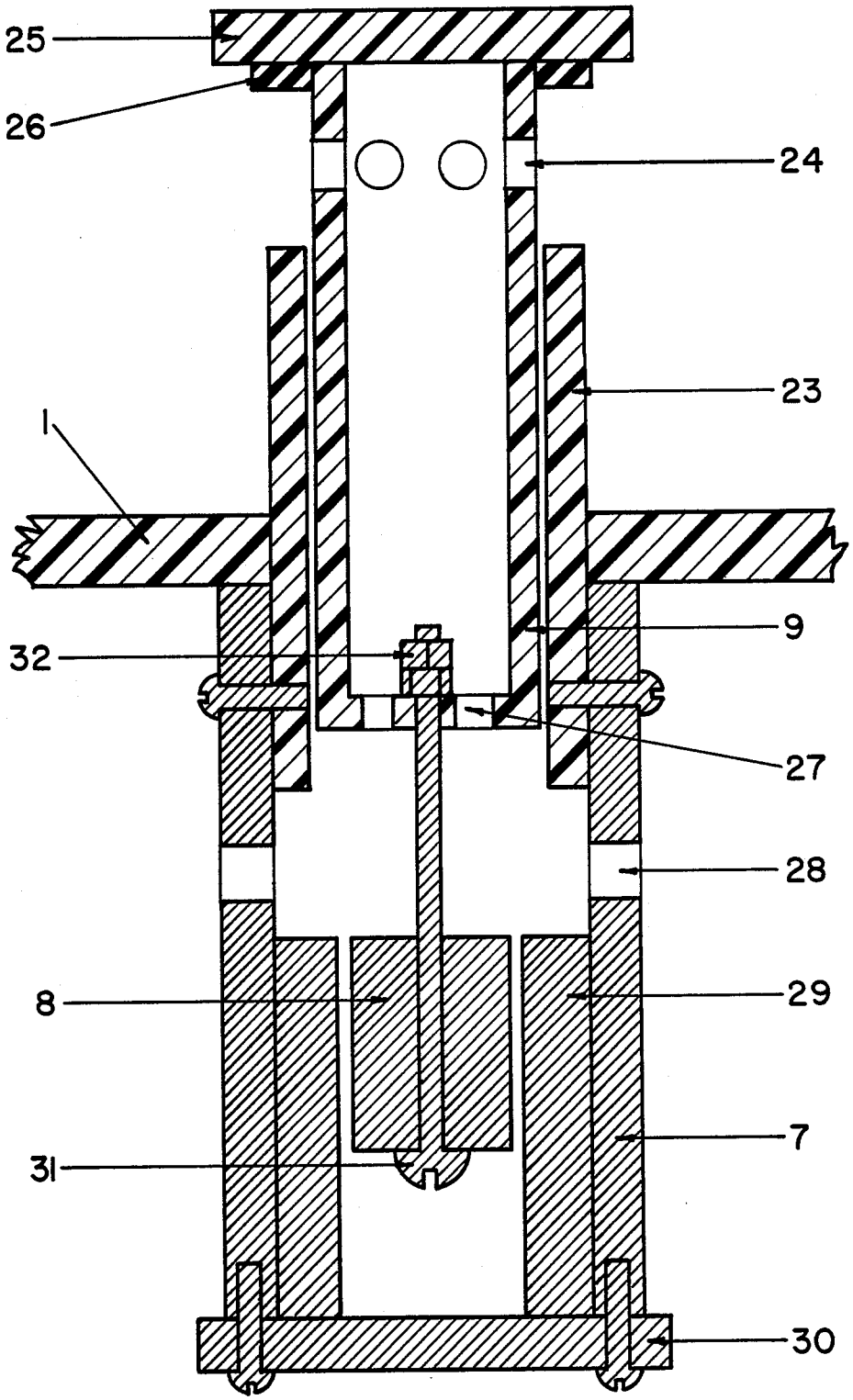
FIG. 4 is a cross section of the air purge valve utilized to control pressure within the cylinder.

Referring to FIG. 4 is the purge valve in detail. The purge valve is located perpendicular to the cylinder 1 by means of a small diameter PCV pipe 23 which is glued to the main cylinder 1.

The housing 7 of the purge valve is constructed of metal and is fastened to PCV pipe 23 with screws. Located internally is the field coil windings 29 and the piston 8. Connected to the piston 8 by means of an adjusting screw 31 is the purge valve plunger 9. The plunger 9, which is constructed of plastic, is a hollow tube with air intake passages 24 and 27. When deactivated the plunger 9 is drawn open by internal vacuum pressure, thus allowing the higher atmospheric pressure to pass through air intake passage 28, then through passage 27 and passage 24. This allows equal pressurization to occur and in turn allows the piston 10 FIG. 1 to return to its original position.

When activated, the plunger 9 is pulled closed by the solenoid piston 8 and sealed by the O-ring 26 and the end plate 25. When the purge valve is activated the pump motor 5 FIG. 1 is activated simultaneously. The air passages 27, 28 and 24 are no longer open to the main cylinder 1 FIG. 1. The pump creates a low pressure area and the piston 10 is drawn downwards.

The plunger 9 and solenoid piston 8 clearance are adjusted by tightening the adjusting screw 31, which is accessible by removal of purge valve end plate 30. The adjusting screw 31 is held in the plunger 9 by a solid mounted nut 32.

Figure 2:
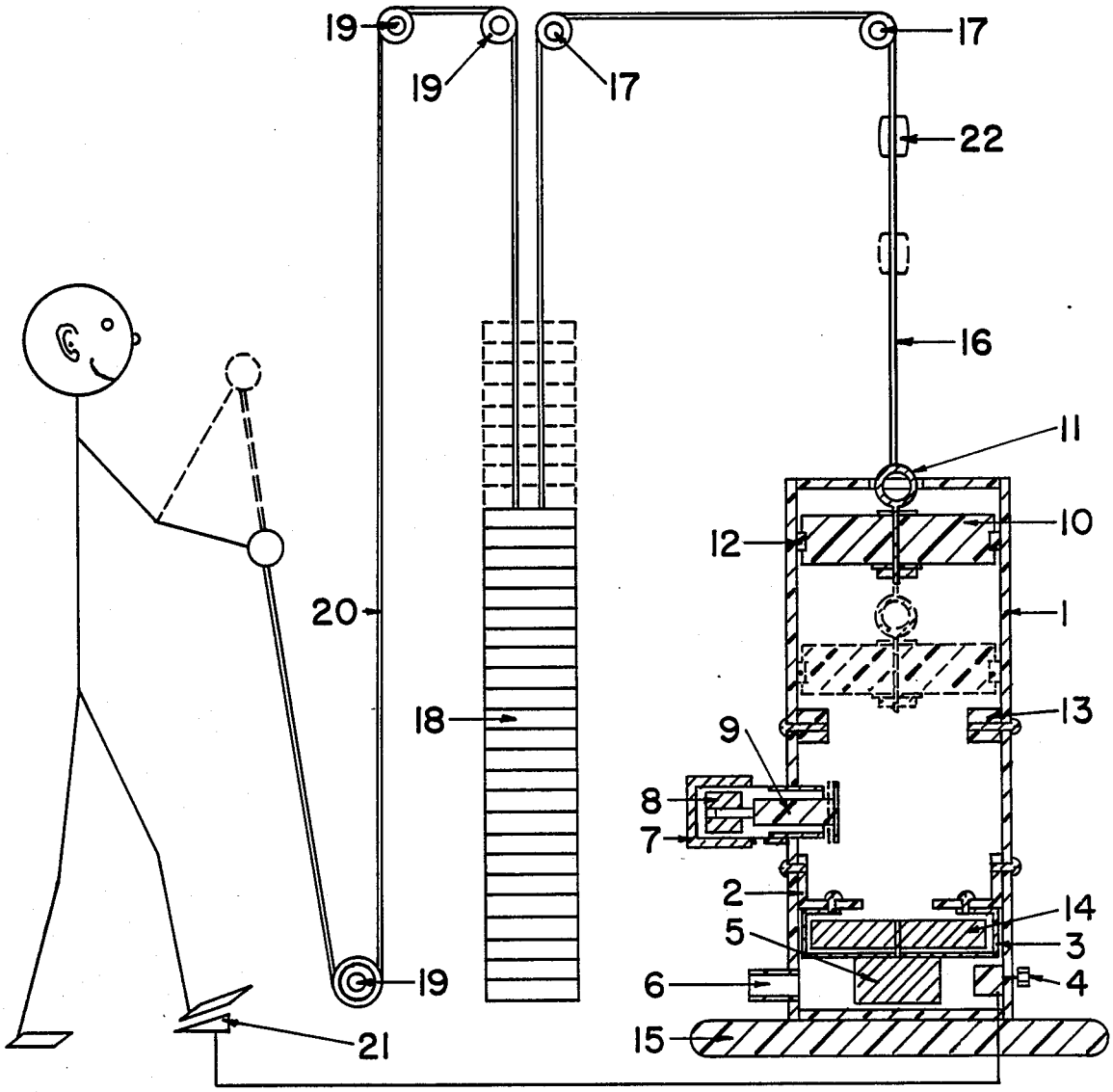
FIG. 2 demonstrates how the Airlift is integrated into the weight lifting machine.
Figure 3:
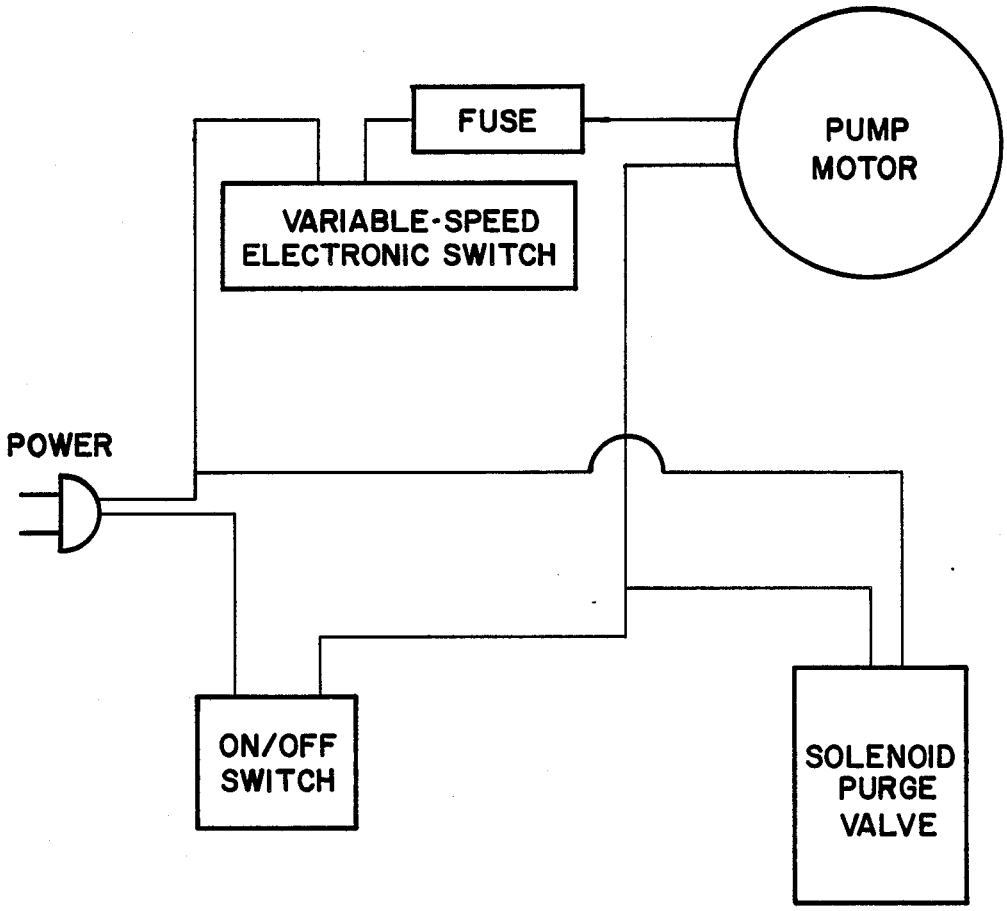
FIG. 3 demonstrates the electrical diagram used in the Airlift unit.

Referring to FIG. 2 the Airlift system is shown in conjunction with a typical weight machine. The weight machine is displayed in a simplified version to convey the general concept. The weight stack 18 is moved by a cable 20 routed through a series of pulleys 19. Force applied to the cable 20 lifts part or all of the weight stack 18 upwards.

The Airlift system is attached to the weight stack 18 by a cable 16. Cable 16 attaches to the eyebolt 11 of the piston 10 and extends to the top of the weight stack 18 attaching to it near cable 20. This cable 16 is routed through a series of pulleys 17, and has a two pound weight 22 attached. The weight 22 keeps tension on the cable 16, thus keeping the cable 16 in the slots of the pulleys 17 when the Airlift system is not being utilized.

When the weight lifter fatigues and requires assistance he/she simply presses the foot switch 21. This, in turn, sends electrical current to the purge valve, closing it and activating the pump motor. A low pressure is created, and the piston 10 is pushed downwards by the greater surrounding atmospheric pressure. The downward draw of the piston 10 lifts the weight stack, giving the necessary aid. When the assist is no longer needed the foot switch 21 is released, the pump motor 5 stops, and the purge valve opens and equal air pressure is resumed. The weight stack 18, returning to its position at rest, draws the piston 10 back to its starting position. The amount of force needed for the assistance can be controlled by the variable speed electronic switch 4.

I claim:

1. A device for giving assistance during the lift in a weight machine when user fatigue occurs, comprising:

a cylinder with a piston reciprocably mounted in said cylinder and sealed with a rubber O-ring;

said piston powered for reciprocation in said cylinder by a differential air pressure;

said differential air pressure produced by vacuum pressure below and atmospheric pressure above said piston which functions as a moveable barrier;

said vacuum pressure produced by an electrical vacuum pump internally mounted at a bottom of said cylinder;

changes of pressure within said cylinder being regulated by a solenoid operated purge valve;

a vacuum pressure force on said piston being controlled by a variable speed electronic switch which monitors electrical current provided to said vacuum pump;

said piston being connected to the weight stack by means of cable and pulleys so that when not being utilized for an assist it will not interfere with normal use of the weight machine;

wherein said assistance device is activated by use of a foot or hand switch.

* * * * *